United States Patent [19]

Talbert

[11] 4,094,720

[45] June 13, 1978

[54] STRIP CORE SHEET LENGTH CONTROL

[75] Inventor: David F. Talbert, Millboro Springs, Va.

[73] Assignee: Westvaco Corporation, New York, N.Y.

[21] Appl. No.: 766,698

[22] Filed: Feb. 8, 1977

[51] Int. Cl.[2] ..... G05G 7/00

[52] U.S. Cl. ..... 156/304; 156/350; 156/351; 156/356; 156/357; 156/358; 156/362; 156/363; 156/367; 156/512

[58] Field of Search ..... 156/260, 264, 350, 351, 156/352, 356, 357, 358, 362, 363, 367, 512, 304

[56] References Cited

U.S. PATENT DOCUMENTS

| | | | |
|---|---|---|---|
| 2,200,269 | 5/1940 | Fischer | 156/512 |
| 2,475,789 | 7/1949 | Kunz | 156/512 |
| 3,477,893 | 11/1969 | Brazener et al. | 156/512 |
| 3,733,235 | 5/1973 | De Ligt et al. | 156/260 |
| 3,979,252 | 9/1976 | Hoyt | 156/512 |

*Primary Examiner*—Caleb Weston
*Attorney, Agent, or Firm*—W. Allen Marcontell; Richard L. Schmalz

[57] ABSTRACT

The cyclic application of glue to one face of strip elements continuously delivered edge-to-edge into a reciprocating kicker breech to be collimated into a row forming sheet assembly having thickness equal to the width of individual sheets is controlled by a cascaded series of relays whereby the remotely operated glue guns are not actuated by the final triggering event in the cycle unless a trigger safety device is released by a measurable addition to the cumulative sheet product within the preceding kicker cycle. Additionally, growth of the sheet accumulation is continuously monitored with an actual length comparison to a desired, set-point length. When the desired length is reached, glue gun operation is restrained for one cycle to provide an unbonded interface between the final strip of a preceding sheet and the first strip of a successive sheet.

10 Claims, 6 Drawing Figures

STRIP CORE SHEET LENGTH CONTROL

BACKGROUND OF THE INVENTION

1. Field Of The Invention

The present invention relates to the manufacture of sheet material from a face-to-face lamination of strip elements aligned with strip face planes perpendicular to the sheet face planes. More particularly, the present invention relates to a system for monitoring the incremental development of a sheet and also the delineation by length of successive sheets in a continuous flow stream.

SUMMARY OF THE PRIOR ART

U.S. Pat. No. 3,733,235 to J. DeLigt et al describes a method and apparatus for fabricating laminated structural panels or sheets. This method basically comprises the cutting of corrugated board into strips which are continuously conveyed edge-to-edge into the breech of a reciprocating hammer element called a "kicker." When the kicker is withdrawn from the breech, a single strip is pushed into the breech with the strip face parallel to the kicker face. As the kicker closes the breech space, the single strip is pushed out of the breech in a direction perpendicular to the strip and kicker face planes into face-to-face contact with the preceding strip.

Within this cyclic sequence, spots of adhesive or glue are placed on the face of each strip at uniformly spaced locations along the strip length. This glue application step is performed by a multiplicity of electric solenoid actuated, pressurized glue guns: one for each glue spot.

In the cyclically continuous outflow of strips from the kicker breech, it is usually desired to delineate successive sheet groupings of strips by sheet length.

Ideally, the glue guns should remain inoperative through the cycle of one strip which represents the first or last strip of a sheet group depending on which strip face the glue is applied to. Due to the periodic absence of glue on the one strip, it is possible to separate the adhered groups in between without further cutting.

Normally, such an omission step in a cyclic sequence could be performed by merely counting the cycles with well known automatic counting means and prohibiting the glue step in the cycle the desired count is reached.

However, due to variations in corrugated board thickness and other process variables, it is not possible to firmly conclude that the cumulative thickness of a predetermined number of strips in a collimated row will add to a predetermined length.

Moreover, if the strip supply sequence is not perfectly reliable, it may not be reliably concluded that the sheet length is increased by a strip width each time the kicker cycles.

The fact that the strip supply is not entirely reliable also creates the problem of excessive glue application to a single strip in the event of a supply jam.

To overcome and prevent these difficulties in the process sequence, the present invention has been conceived and developed.

One object of the invention is to monitor the cyclic ejection of strips from the kicker breech in such a way that the glue guns are not allowed to applicate a particular strip but once.

Another object of the invention is to accumulate, in small increments, a running total of sheet length actually flowing from the kicker breech for the purpose of transmitting a glue gun disabling signal when the desired length is reached.

Other methods and apparatus for the control of similar incremental product building process may be learned from U.S. Pat. No. 2,200,269 to A. C. Fischer, U.S. Pat. No. 2,475,789 to B. P. Kunz, U.S. Pat. No. 3,477,893 to H. M. Brazener et al, U.S. Pat. No. 3,956,617 to R. W. Schmidt and U.S. Pat. No. 3,979,252 to E. R. Hoyt.

SUMMARY OF THE INVENTION

The electric triggers for solenoid actuated, pressurized glue guns are controlled by a cascade relay system whereby several events must occur in the required sequence before the guns are actuated.

The final event in the control sequence is the physical position of the kicker in the reciprocation cycle. As the kicker face advances into the kicker breech, a first photocell beam is broken to transmit a gun actuating signal for glue to be ejected onto the strip face therein through apertures in the kicker face. Immediately thereafter, the trigger circuit is rendered safe by a switch that is also reliably functioned by the mere positionment of the kicker in the cycle.

Before the gun triggering circuit may be armed for the next kick cycle, material must actually flow from the breech. This event is monitored by a calibrated odometer wheel that is rotated by movement of the sheet out from the breech. This calibrated wheel is provided with uniformly spaced apertures around the periphery thereof whereby a second photocell beam aimed therethrough is broken by rotation of the wheel. From this arrangement, the length of sheet passing in contact with the wheel rim may be concluded from the number of times the photo beam is broken.

With each interruption of the length measuring photo beam, an electrical pulse is emitted for a two-fold purpose. First, the pulses are counted in a cumulative inventory by one of several suitable prior art counting devices. Secondly, since the emission of such pulses signify a positive addition to the product sheet length and therefore continued strip flow through the kicker breech, such pulses are used to arm the glue gun triggering circuit for the next kick cycle.

When, however, the sheet product reaches the predetermined length as signified by the total number of pulses emitted by the length measuring photo beam, a signal is emitted to reset the counter and to interrupt the glue gun arming circuit whereby one strip is allowed to cycle through the kicker breech without receiving a glue application.

Should the strip supply stream to the kicker breech be interrupted, the preceding strip will receive a double application of glue on the next kicker cycle. However, immediately after the guns applicate the previously ejected strip for the second time, the safety switch renders the gun triggering circuit inoperative until additional material movement from the breech inactivates the safety switch. This condition will remain until resumption of the strip supply notwithstanding continued cycling of the kicker.

Moreover, since the cumulative length measurement of collimated sheet product is predicated only on actual material addition to the assembly as determined by rotation of the odometer wheel, the cumulative length count of a continuous assembly will remain accurately stored in the pulse counter notwithstanding numerous empty cycles of the kicker within the accumulation interim.

DESCRIPTION OF THE PREFERRED EMBODIMENT

Figure 1A:
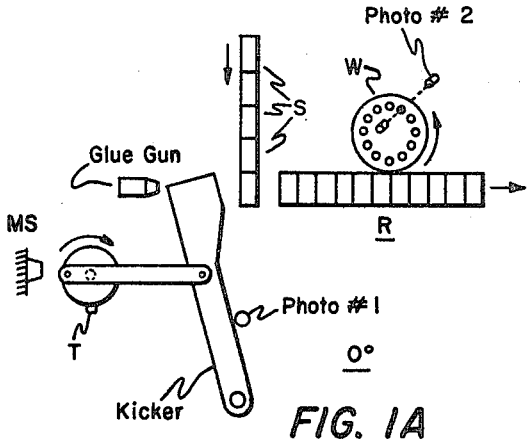
FIGS. 1A through 1D schematically illustrate the physical arrangement of certain components of the invention relative to the strip material flow and the reciprocation cycle of the kicker.
Figure 1B:
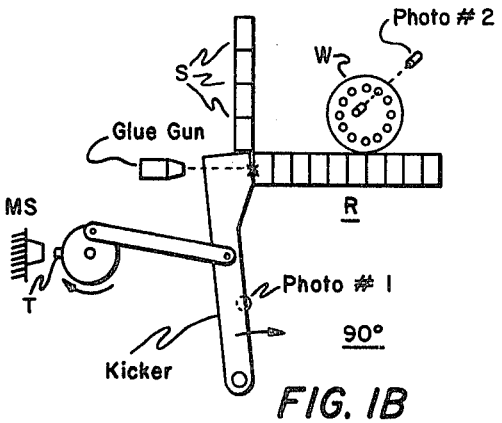

The mechanical environment of the present invention is represented by FIGS. 1A through 1B which respectively show the kicker element in four, quadrantly separated positions within a 360° kicker cycle.

For a broader perspective of the invention environment, reference is made to U.S. Pat. No. 3,733,235 which describes the entire machine, its operation and product in detail. For this purpose, the disclosure of that patent is incorporated herewith by reference.

Figure 2:
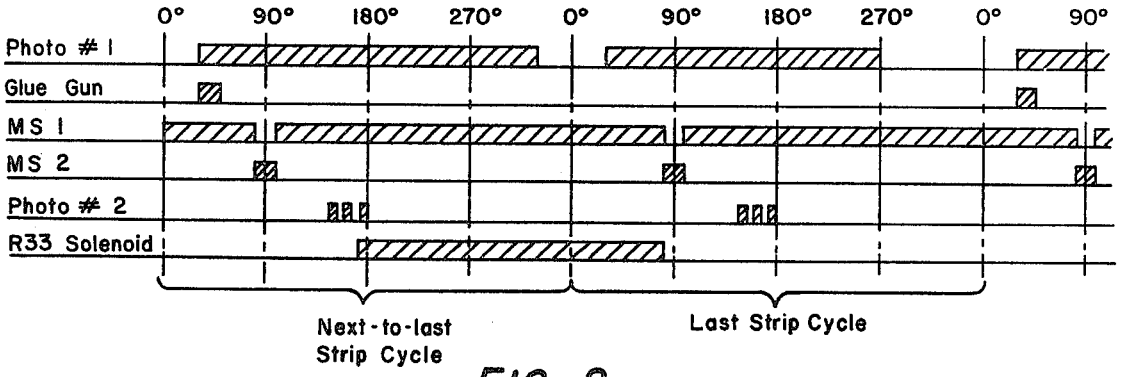
FIG. 2 is a functional flow chart which illustrates the functional status of several components of the invention at respective times or positions in the kicker cycle.

FIG. 2 illustrates the operational status of several critical elements of the combination relative to the cycle positions illustrated by FIGS. 1A through 1B. To facilitate explanation of the full capacity of the invention, FIG. 2 graphically represents the operational status of these critical elements over two and one-half kicker cycles. The shaded areas assigned to a respectively identified component represent a switch closed or operative status for that component.

From the left-hand axis of FIG. 2, the 0° position coordinates with the 0°, FIG. 1A illustrated position of the kicker. At this point, in the kicker cycle, the kicker face is fully withdrawn from the kicker breech space and the edge-to-edge supply stream of material strips S has moved to position the individual leading strip in the breech.

The 90° kicker position of FIGS. 1B and 2 illustrates the kicker face as having moved the breeched strip S into face-to-face contact with preceding strips which, collectively, form the collimated row R.

The dashed line between the gun and the breeched strip is projected through the kicker head to indicate the preferred point of glue application which passes through aperatures in the kicker face. The multiplicity of guns spaced along the strip S length may actually be mounted on the kicker head or appropriately aligned apertures may be provided in the kicker face structure through which a shortburst stream of pressurized glue is jetted.

Although the glue discharge is represented by FIG. 1B at the 90° kicker position, FIG. 2 will reveal that the discharge actually occured at the 30° kicker position not illustrated.

Figure 1C:
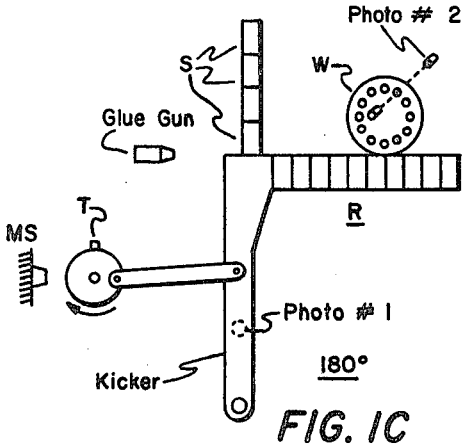

When the kicker reaches the full stroke, 180° position of FIG. 1C, the previously breeched strip S moving before the kicker face has displaced the entire row R of collimated strips to cause rotation of a calibrated odometer wheel W riding on the top face of the row.

Figure 1D:
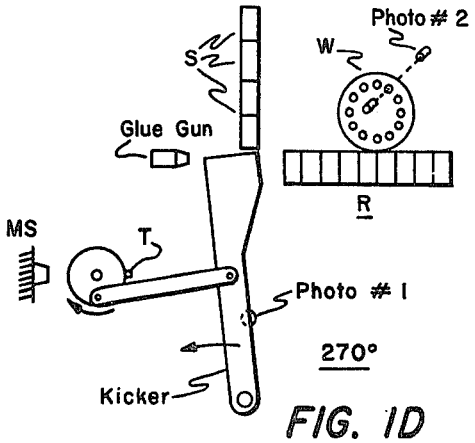

At the 270° cycle position of FIG. 1D, all product material flows are at rest while the kicker retreats from the row R face but still occupies the breech space to prevent further movement of the strip S supply column.

Relative to the two successive full cycles. illustrated by FIG. 2, the first cycle describes the next-to-last strip S addition to a completed panel or sheet assemblage. The next 180° cycle span illustrates the last strip addition to a sheet which is distinguished by restraint of the glue gun operation. Since the present embodiment provides for glue to be applied to the trailing face of a strip S relative to the cumulative growth direction of a row R, omission of glue from the last strip will provide a bond-free interface between such last strip and the first strip of a successive sheet. Consequently, the continuum of two adjacent sheets may be easily and neatly separated with-out additional cutting means.

Development of all intermediate cycles will be identical to that of the next-to-last strip cycle but for one exception which will subsequently become obvious.

Mechanical subcomponents for the present invention comprise the following. Photocell beam unit 1 of well known construction and operation is positioned in the cyclic path of the kicker for beam interruption approximately at the 30° position not illustrated. A magnetically actuated double-pole-double-throw switch MS is positioned to be actuated by the cyclic proximity of a passive trigger element T linked to the kicker by a crank shaft drive arrangement. The odometer wheel W is provided with apertures around the periphery thereof to alternately pass and break the beam of a second photocell unit 2 as the wheel W is rotated by movement of the row R against rim thereof. In the present example, the apertures were circumferentially separated to provide a make/break cycle of the photocell 2 beam for each 0.10 inch of row R length movement.

Figure 3:
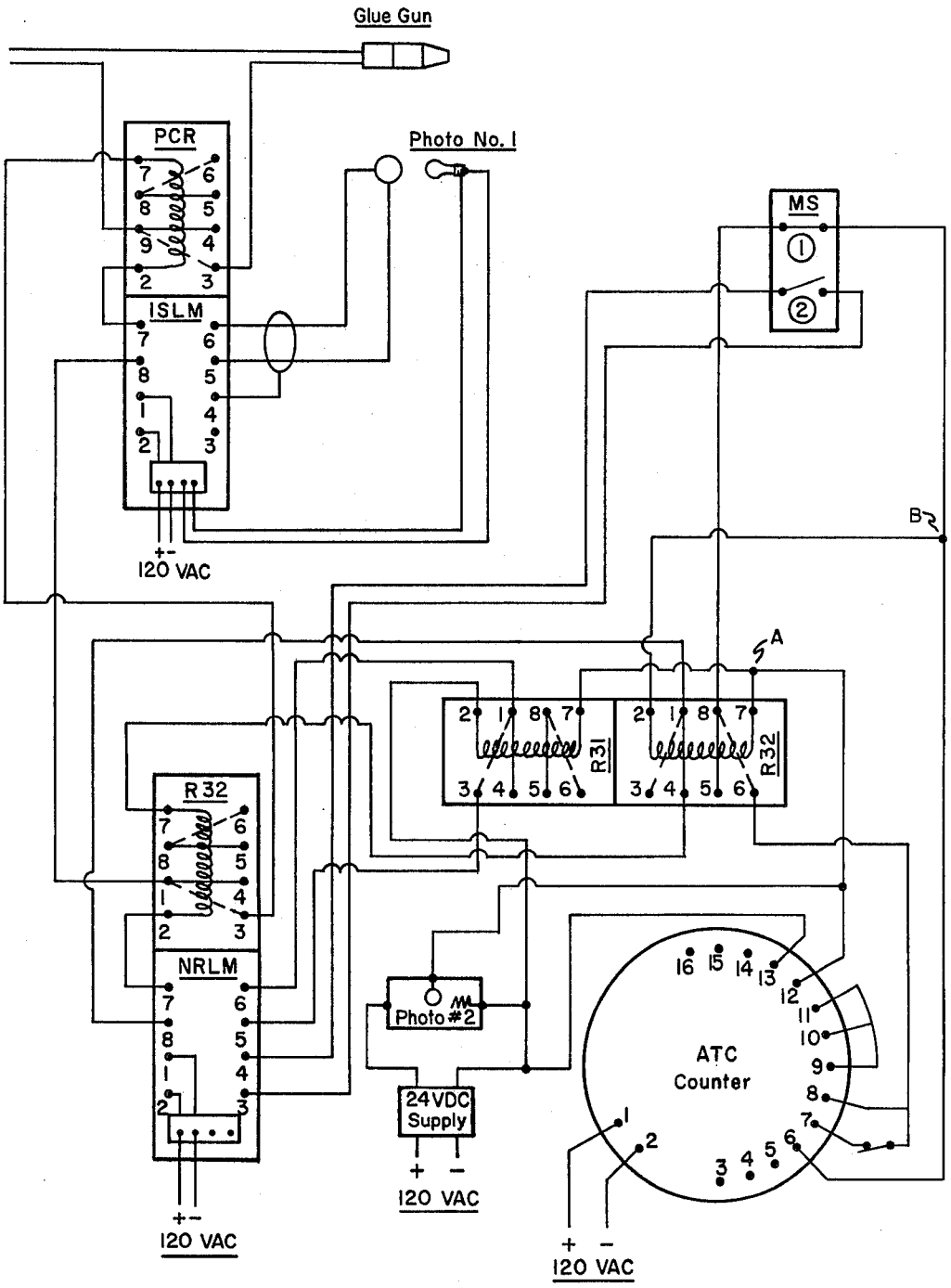
FIG. 3 is a wiring schematic of the invention.

Electrical subcomponents of the invention illustrated by FIG. 3 include a pair of solenoid switch units PCR and R-32 which are operated by logic modules 1SLM and NRLM, respectively. For a more specific description, reference is given to the Farmer Electric Products Company, Inc. of Natic, Massachusetts.

The PCR and 1SLM unit combination may be a Farmer Electric logic module model TR4 having the characteristic that momentary closure of a circuit between 1SLM terminals 5 and 6 results in connection of an internal power source across terminals 7 and 8 for a measured interim of time. At the end of the terminal 7, 8 power burst, the event will not repeat until the module is reset by a momentary opening of the circuit between terminals 5 and 6.

The effect of photocell 1 connected to 1SLM terminals 5 and 6 is to close the circuit when the photo beam is broken.

The R32 and NRLM unit combination may be a Farmer Electric logic module model TR4-2L having the characteristic that a momentary circuit closure between NRLM terminals 5 and 6 set an application of power across terminals 7 and 8 which continues until the unit is reset by a momentary circuit completion across NRLM terminals 3 and 4 whereupon terminals 7 and 8 are de-energized until another closure of terminals 5 and 6.

Double-pole-double-throw magnetic switch MS comprises a normally (de-energized) closed switch 1 and a normally open switch 2. Switch activation energy is derived from the trigger element T which is driven through a magnetic field. As the trigger T breaks the magnetic flux field, normally closed switch MS-1 opens and normally open switch MS-2 closes to reset the NRLM.

For counting the row length proportional pulses from the photocell 2, a count controller device, ATC counter, such as the Automatic Timing and Controls Co., King of Prussia, Pa., Model Series 334 Shawnee may be used. With this device, photocell 2 pulses added to the terminal 12 are accumulated internally. The accumulated inventory is continuously compared to a manually determined set-point. When the inventory accumulates the set-point number of pulses, the count is re-set to zero and internal power is applied to terminal 6 for a 60 MS burst. Terminal 8 of the ATC counter provides a continuously available potential.

FIG. 3 components R31 and R33 are conventional solenoid switching units of a well known type.

Operation of the present invention is best followed from a progressive description of events occurring to the FIG. 3 electrical components throughout the two successive cycles of FIG. 2.

Each time the kicker bar strokes, the beam of photocell 1 is broken at the 30° cycle position and remains broken through the 330° position to pulse a signal to 1SLM terminals 5 and 6. When 1SLM terminals 5 and 6 receive the photocell 1 signal, 1SLM terminals 7 and 8 are connected across an internal power source. To actuate the glue gun, however, this energy must be conducted across PCR solenoid terminals 2,7 so that the switch between gun energizing terminals PCR-1,3 will close. However, the PCR-2,7 and 1SLM-7,8 circuit loop includes the switch across R32 terminals 1 and 3 which is normally open. Therefore, the gun does not function with each cycle of the kicker bar unless R32 solenoid terminals 2,7 are energized.

Energy for the R32 solenoid is an internal power source selectively connected across NRLM terminals 7 and 8. This occurs when a circuit is completed between NRLM terminals and 5 and 6. If the 5,6 circuit is momentarily completed, the potential applied across NRLM-7,8 continues until broken by a reset signal derived from a circuit completion between NRLM terminals 3 and 4.

In the circuit between NRLM terminals 3 and 4 is the normally open switch MS-2 which is one of a pair of oppositely phased, magnetically actuated switch elements. Functional energy for the magnetic switch MS is derived from a crankshaft driven cam linked to the kicker bar which cyclically breaks a magnetic force field in the switch body. This also occurs at the 30° cycle position whereupon MS-2 is closed to provide continuity between NRLM reset terminals 3 and 4 thereby de-energizing NRLM-7,8. The effect of this subsystem is to render the glue gun energizing system "safe" with each cycle of the kicker bar until another event occurs.

The final event in the cycle prestiging glue application is the actual advancement of strip material before the kicker bar face. When the collimated strip row R is pushed forward, the perhipherally perforated wheel W riding the row surface is rotated thereby breaking the beam of photocell 2 once for each 0.1 inch of row R advancement.

If, due to other malfunctions, a strip S did not descend into the kicker breech, no row advancement would occur when the kicker bar approached the 180° cycle position.

Normally, however, the row is advanced and the photocell 2 beam is broken to emit a distinct signal pulse to the ATC counter terminal 12 and the R31 solenoid terminal 2,7 circuit for each 0.1 in. the collimated strip row R is advanced.

Due to the energy pulse across the solenoid between R31-2,7, the switch between R31 terminals 1 and 3 is closed to complete the NRLM-5,6 set circuit thereby applying potential across NRLM-7,8. This NRLM potential is continued across the normally closed switch between R33 terminals 1 and 4 and through the R32 actuating solenoid between R32-2,7. The R32 solenoid consequently closes the normally open switch between R32 terminals 1 and 3 to complete the energy continuity between 1SLM terminals 7 and 8 (closed and energized from 30° to 330°) with the PCR solenoid terminals 2 and 7; the end result being to close the normally open switch between PCR terminals 1 and 3 and energize the glue gun.

The circuit which carries the photocell 2 pulses to the R31 solenoid and the ATC counter junctions at point A to connect with the R33 solenoid across R33-2,7. The R33 solenoid lateral further junctions at point B to connect, in one direction, with the normally open ATC counter terminal 6 and, in another direction, serially across normally closed MS-1 and normally open R33 switch terminals 6 and 8 to the continuously energized ATC counter terminal 8.

Throughout the accumulation interim of a measured length of collimated strip row R, the length counting pulses from photocell 2 are transmitted only to the R31 solenoid and the ATC counting terminal 12 because the conductor circuit beyond junction A is open; at ATC terminals 6 in one direction and at R33 switch 6,8 in the other direction.

When, however, the prescribed number of photocell 2 pulses are received at the ATC counting terminal 12, a 60 MS energy pulse is emitted from ATC terminal 6. This 60 MS pulse is initially conducted from junction B across the R33 solenoid to junction A. Consequently, the R33-6,8 switch is closed to connect the junction B with the continuously energized ATC terminal 8. When the ATC-6 pulse ceases, energy from ATC-8 continues energization of the R33 solenoid to hold the R33-6,8 switch closed.

Energization of the R33 solenoid simultaneously opens R33-1,4 switch. Therefore, power from the NRLM-7,8 terminals is blocked from energizing the R32 solenoid and, hence, operating the glue gun over the next successive kicker bar cycle. This permits one strip to be cycled through the kicker breech without glue to separate a preceding row length from a successive length in the otherwise continuous flow.

The glue gun blocking event starts, in the kicker bar cycle, between 150° to 180°. One of the several photocell 2 pulses will provide the final addition to the ATC count which starts the 60 MS pulse from ATC-6. The glue gun blocking event continues while the R33 solenoid holding circuit is broken which occurs by the opening of MS-1 at the 90° cycle position.

Those skilled in the art will understand that other equivalent subcomponent may be substituted in the total system described. For example, a magnetic proximity switch or a physical contact limit switch could be substituted for photocell 1. Similarly, a magnetic proximity switch could be substituted for photocell 2 by providing a multiplicity of trigger lobes in lieu of the apertures in wheel W.

Therefore, having fully described my invention,

I claim:

1. A method of controlling the discharge of adhesive from a remotely actuated, pressurized gun onto one face of elongated material strips delivered in continuous, edge-to-edge, individual succession to a collimating breech for face-to-face laminated assembly production by cyclically reciprocating kicker means comprising the steps of:

A. Generating a first signal when said kicker means passes a first position in a 360° kicker cycle to operate said gun for adhesive discharge onto one of said strips;

B. Generating a second signal when said kicker means passes a second position in said cycle later than said first position to disable said gun from operation by said first signal; and, C. Generating a third signal when said kicker means passes a third position in said cycle later than said second position and in response to a positive, face-to-face addition of a strip to a preceding assembly, said third signal being effective to inactivate the disabling result of said second signal and enable said gun to be operated by said first signal.

2. A method as described by claim 1, additionally comprising the steps of:

A. Generating a fourth signal proportional to the linear addition of a strip to the length of said assembly;

B. Accumulating an inventory of cyclically successive fourth signals; and

C. Generating a fifth signal when said inventory reaches a predetermined quantity to disable said gun from operation by said first signal over a portion of said kicker cycle including said first position.

3. A method as described by claim 2 additionally comprising the step of inactivating the result of said fifth signal and otherwise enable said gun for operation by said first signal on the next successive kicker cycle.

4. An apparatus for controlling the discharge of adhesive from a remotely actuated, pressurized gun onto one face of elongated material strips delivered in continuous, edge-to-edge, individual succession to a collimating breech for face-to-face laminated assembly production by a cyclically reciprocating kicker means comprising:

A. First means for generating a first signal when said kicker means passes a first position in a 360° kicker cycle;

B. Second means responsive to said first signal to operate said gun for adhesive discharge onto one of said strips;

C. Third means for generating a second signal when said kicker means passes a second position in said cycle later than said first position;

D. Fourth means responsive to said second signal to disable said gun from operation by said first signal;

E. Fifth means for generating a third signal when said kicker means passes a third position in said cycle later than said second position and in response to a positive, face-to-face addition of a strip to a preceding assembly; and, F. Sixth means responsive to said third signal to inactivate said fourth means and enable said gun to be operated by said first signal.

5. Apparatus as described in claim 4 wherein said fifth means comprises an odometer wheel having rim contact with said production assembly and third signal pulsing means for emitting a signal pulse for each of a predetermined linear increment of assembly in passing contact with said rim.

6. Apparatus as described by claim 5 comprising third signal counting means for accumulating an inventory of cyclically successive third signal pulses.

7. Apparatus as described by claim 6 wherein said counting means comprises count monitor means for generating a fourth signal when said inventory reaches a predetermined quantity to reset said counting means.

8. Apparatus as described by claim 7 comprising seventh means responsive to said fourth signal to disable said gun from operation by said first signal over a portion of said kicker cycle including said first position.

9. Apparatus as described by claim 8 comprising eighth means for inactivating said seventh means at the end of said cycle portion which includes said first position and otherwise enable said gun for operation by said first signal on the next successive kicker cycle.

10. Apparatus as described by claim 9 wherein said seventh means is a self-energizing relay circuit and said eighth means is a switch therein that is cyclically opened by the passage of said kicker means through said second position to de-energize said relay circuit.

* * * * *

UNITED STATES PATENT OFFICE

CERTIFICATE OF CORRECTION

PATENT NO. : 4,094,720

DATED : June 13, 1978

INVENTOR(S) : David F. Talbert

It is certified that error appears in the above-identified patent and that said Letters Patent are hereby corrected as shown below:

Column 3, line 67, following "cycles," delete --.--. Column 8, line 17 (Claim 5, line 1), delete "in," and insert --by-- therefor.

Signed and Sealed this

*Twenty-fourth* Day of *October 1978*

[SEAL]

*Attest:*

RUTH C. MASON
*Attesting Officer*

DONALD W. BANNER
*Commissioner of Patents and Trademarks*